US005624244A

United States Patent [19]

Moon

[11] Patent Number: 5,624,244

[45] Date of Patent: Apr. 29, 1997

[54] CIRCULATING PUMP FOR COOLING WATER TO BE FORCIBLY CIRCULATED

[75] Inventor: Sung-Dai Moon, Kyeongsangbook-Do, Rep. of Korea

[73] Assignee: Daewoo Electronics Co., Ltd., Seoul, Rep. of Korea

[21] Appl. No.: 581,935

[22] Filed: Jan. 2, 1996

[30] Foreign Application Priority Data

Jul. 25, 1995 [KR] Rep. of Korea ..... 95-22075

[51] Int. Cl.[6] ..... F04B 39/06

[52] U.S. Cl. ..... 417/366

[58] Field of Search ..... 417/366, 423.9, 417/423.11, 423.12, 423.14, 423.8; 415/58.2, 168.3

[56] References Cited

U.S. PATENT DOCUMENTS

| | | | |
|---|---|---|---|
| 2,592,612 | 4/1952 | Smith, Jr. | 415/168.3 |
| 2,936,715 | 5/1960 | Southam et al. | 415/168.3 |
| 3,420,184 | 1/1969 | Englesberg et al. | 415/168.3 |
| 3,967,915 | 7/1976 | Litzenberg | 417/423.14 |
| 4,990,068 | 2/1991 | Zhong et al. | 417/423.12 |
| 5,248,245 | 9/1993 | Behnke et al. | 417/366 |
| 5,464,333 | 11/1995 | Okada et al. | 417/420 |

*Primary Examiner*—Timothy S. Thorpe
*Assistant Examiner*—Peter G. Korytnyk
*Attorney, Agent, or Firm*—Beveridge, DeGrandi, Weilacher & Young, LLP

[57] ABSTRACT

The present invention relates to a circulating pump for pressurizing and circulating fluid in a system such as a boiler. An object of the present invention is to provide an improved structure of an impeller body and a motor shaft so that a substance such as mud is prevented from being accumulated in a motor while the motor is sufficiently cooled. The circulating pump comprises a motor, an impeller and a pump housing. At the outer surface of motor shaft a spiral groove is formed and at the center of motor shaft a cooling water discharging passage is formed along the axis of the motor shaft. At a lower portion of an impeller body a curved projecting portion forming a cooling water inflow chamber by joining together with motor shaft is provided and a plurality of cooling water outlet holes are formed therein. At an upper end of cooling water discharging passage a ball seat with a ball therein is provided. Fluid pressurized into in the inpeller chamber by the impeller returns into the impeller through a spiral groove and cooling water discharging passage of the motor shaft under the action of pressure difference of fluid between the impeller chamber and the impeller and rotation of the spiral groove.

11 Claims, 8 Drawing Sheets

CIRCULATING PUMP FOR COOLING WATER TO BE FORCIBLY CIRCULATED

BACKGROUND OF THE INVENTION

1. Field of the Invention

The present invention relates to a circulating pump for pressurizing and circulating fluid in a system such as a boiler, and more particularly to a circulating pump for cooling water to be forcibly circulated in such a manner that fluid pressurized into an impeller chamber by an impeller flows through a spiral groove formed at the outer surface of a motor shaft and a cooling water discharging passage formed at the center of the motor shaft and returns into the impeller under a pressure difference between the impeller chamber and an inside of the impeller so that a motor of the circulating pump is cooled.

2. Description of the Prior Art

In general, a circulating pump is equipped in a system such as a boiler for circulating fluid under the action of pressure. Such a circulating pump conventionally comprises a motor acting as a power source for the circulating pump; an impeller which is combined with an output shaft of the motor, rotates together with the motor shaft according to the rotation of the motor shaft, and directly pressurizes fluid; and a pump housing which receives the impeller and includes an inlet passage for allowing fluid to flow into the impeller and an outlet passage for allowing fluid pressurized by the impeller to flow out of the impeller.

In such a prior-art circulating pump, fluid that has flowed into the pump housing through the inlet passage of the pump housing is pressurized by the impeller rotating according to the rotation of the motor and flows out of the pump housing through the outlet passage thereof.

FIG. 1 and FIG. 2 show one of the embodiments for the prior-art circulating pump as described above.

According to FIG. 1 and FIG. 2, a prior-art circulating pump 1 comprises a motor 10, an impeller 20 and a pump housing 30.

Motor 10 includes a stator 11, a rotor 12 and a motor shaft 13. Stator 11 is fixed inside a motor housing 14. Rotor 12 is fixedly assembled with motor shaft 13 and separated from stator 11 by a stator can 15. One end of motor shaft 13 is supported by a lower bearing holder 16*a* and a lower bush bearing 17*a* at the inner bottom of motor housing 14. The other end of motor shaft 13 passes through a motor end shield 18 and is supported by an upper bearing holder 16*b* and an upper bush bearing 17*b* at motor end shield 18. Motor shaft 13 is supported by a trust bearing 17*c* which is to keep the motor shaft 13 from rising in an axial direction of the motor shaft 13. Between lower bearing holder 16*a* and stator can 15, an O-ring 19*a* is provided to prevent fluid from leaking out. Likewise, an O-ring 19*b* prohibits the leakage of fluid between motor end shield 18 and stator can 15.

Impeller 20 includes an impeller body 21 and a shroud 22. Impeller body 21 and shroud 22 are, in general, connected to each other by an ultrasonic welding. Impeller body 21 is tightly fitted at the other end of motor shaft 13 by a bush 23. At the center of shroud 22 a through hole 24 is formed.

Pump housing 30 is disposed onto motor 10. Pump housing 30 includes an inlet passage 31 and an outlet passage 32 at its right and left sides respectively and an impeller chamber 33 at the center thereof. Impeller 20 is disposed inside impeller chamber 33. A suction ring 34 with a flange 34*a* and a cylinder 34*b* is provided at one end of inlet passage 31 of pump housing 30 just above shroud 22 of impeller 20. A fluid guide hole 35 is formed at the center of suction ring 34. Cylinder 34*b* of suction ring 34 protrudes with a predetermined length into through hole 24 formed at the center of shroud 22 of impeller 20. Between through hole 24 of shroud 22 and an outer wall of cylinder 34*b* of suction ring 34, and between an upper end of shroud 22 and a lower side of flange 34*a* of suction ring 34, some measure of clearance is provided. An O-ring 19*c* is provided to prevent fluid from leaking out between pump housing 30 and motor end shield 18.

According to the prior-art circulating pump constructed as above, when an electric current is applied to stator 11 of motor 10, motor shaft 13 which is rotatably supported against motor housing 14 by means of lower bush bearing 17*a* and upper bush bearing 17*b* rotates by an electromagnetic force occurring between stator 11 and rotor 12. Accordingly, impeller 20 which is tightly fitted at one end of motor shaft 13 by means of bush 23 rotates. When impeller 20 rotates, the fluid that has flowed into impeller 20 through inlet passage 31 and suction ring 34 of pump housing 30 is pressurized by impeller 20 and is delivered into impeller chamber 33 and subsequently to outlet passage 32. At this time, some of the pressurized fluid in impeller chamber 33 flows into stator can 15 through a gap between motor shaft 13 and upper bush bearing 17*b*. The fluid that has flowed into stator can 15 cools motor 10. The fluid which has entered stator can 15 reversely rises to flow into impeller chamber 33, and thereafter flows out of impeller chamber 33 together with other pressurized fluid therein through outlet passage 32.

However, according to the prior-art circulating pump constructed as above, since fluid that has flowed into stator can 15 through the gap between motor shaft 13 and upper bush bearing 17*b* is small in quantity, motor 10 can not be cooled satisfactorily. As such, since heat generated by friction between motor shaft 13 and bearings 17*a*, 17*b* and 17*c* is not sufficiently cooled, motor shaft 13 and bearings 17*a*, 17*b* and 17*c* are apt to be worn away earlier, and therefore the efficiency of pump 1 decreases and the expected life of pump 1 is shortened.

Also according to the prior-art circulating pump constructed as above, when a substance such as mud enters stator can 15 together with fluid through the gap between motor shaft 13 and upper bush bearing 17*b*, since the gap between motor shaft 13 and upper bush bearing 17*b* is quite narrow, the substance that has entered thereinto is hardly discharged to impeller chamber 33 again. That is, the substance remains in the stator can 15. At this time, if the substance gets in between motor shaft 13 and lower bush bearing 17*a*, a lubricative rotation of motor shaft 13 can be obstructed. Especially, if pump 1 is not used for a long time, the substance will solidify so the rotation of motor shaft 13 could be impossible.

FIG. 2 and FIG. 3 show a second embodiment for the prior-art circulating pump according to the "CIRCULATING PUMP" disclosed in a U.S. patent application based upon Korean patent application No. 18229/95 of the same inventor and simultaneously filed with the present application.

In accordance with FIGS. 2 and 3, a prior-art circulating pump 51 comprises a motor 60, an impeller 70 and a pump housing 80.

Motor 60 includes a motor housing 64. A stator 61 is fixed inside motor housing 64. Stator 61 is separated from fluid by a stator can 65, a motor end shield 68 and a plurality of O-rings 69*a*, 69*b* and 69*c*. A rotor 62 is fixedly assembled with a motor shaft 63. One end of motor shaft 63 is supported rotatably and slidably in an axial direction of the motor shaft 63 by a lower bearing holder 66*a* and a lower bush bearing 67*a* at the inner bottom of motor housing 64. The other end of motor shaft 63 passes through a through hole 68*a* formed at a motor end shield 68 and is supported rotatably and slidably in the axial direction by an upper bush bearing 67*b* at motor end shield 68. Between lower bearing holder 66*a* and stator can 65, O-ring 69*a* prohibits fluid from leaking out. Likewise, O-ring 69*b* prohibits fluid from leaking out between motor end shield 68 and stator can 65.

Impeller 70 includes an impeller body 71 and a shroud 72. Impeller body 71 and shroud 72 are connected to each other by an ultrasonic welding. Impeller body 71 has a plurality of blades 71*a* for pressurizing fluid and is fixedly assembled with the other end of motor shaft 63. One end of shroud 72 is tightly fixed onto impeller body 71, and at the center thereof a through hole 73 is formed. An inclined surface 73*a* is formed at an upper edge portion of through hole 73. At the other end of shroud 72, there is provided an annular flange 72*a* with a plurality of grooves 72*b* thereon.

Pump housing 80 is disposed onto motor 60. Pump housing 80 includes an inlet passage 81 and an outlet passage 82 provided at both sides thereof respectively and an impeller chamber 83 formed at the center thereof. Impeller 70 is disposed inside impeller chamber 83. Impeller chamber 83 is communicated with inlet passage 81 and outlet passage 82 respectively. A suction ring 84 is provided at one end of inlet passage 81. Suction ring 84 includes a flange 84*a* and an inclined guiding portion 84*b* with the same angle with an inclined surface 73*a* of shroud 72. Between pump housing 80 and motor end shield 68, O-ring 69*c* is provided to prevent fluid from leaking out.

According to the prior-art circulating pump constructed as above, when a current is applied to stator 61 of motor 60, motor shaft 63 which is rotatably supported against motor housing 64 by means of lower bush bearing 67*a* and upper bush bearing 67*b* rotates by an electromagnetic force occurring between stator 61 and rotor 62. Accordingly, impeller 70 which is tightly fitted at one end of motor shaft 63 rotates. When impeller 70 rotates, fluid flows into impeller 70 through inlet passage 81 and suction ring 84 of pump housing 80. The fluid is pressurized by rotating impeller 70 and is delivered into impeller chamber 83 and subsequently to outlet passage 82. When impeller 70 rotates, fluid that has flowed through inlet passage 81 thereinto is pressurized into impeller chamber 83 by a plurality of blades 71*a* of impeller 70, accordingly the fluid pressure in impeller chamber 83 is higher than that in an inside of impeller 70. Accordingly, impeller 70 is forced toward suction ring 84. Meanwhile, since motor shaft 63 at which impeller 70 is fixed is supported against motor housing 64 rotatably and slidably in the axial direction by lower bush bearing 67*a* and upper bush bearing 67*b*, impeller 70 axially rises toward suction ring 84 while rotating.

Further, since the fluid pressure in impeller chamber 83 is higher than that in the inside of impeller 70, the pressurized fluid in impeller chamber 83 is reversed to flow to inlet passage 81 through clearances between the upper side of annular flange 72*a* of shroud 72 and the lower side of flange 84*a* of suction ring 84 and between inclined surface 73*a* of shroud 72 and inclined guiding portion 84*b* of suction ring 84. At this time, the fluid that has flowed into the clearance between the upper side of annular flange 72*a* of shroud 72 and the lower side of flange 84*a* of suction ring 84 is affected by a centrifugal force going back toward the outside of annular flange 72*a* by a plurality of grooves on annular flange 72*a*. Fluid that has flowed into the clearance and fluid pressurized outward by grooves 72*b* conflict with each other around outer ends of grooves 72*b*. This fluid confliction makes a fluid film with considerable pressure between shroud 72 and suction ring 84. The fluid film serves as a fluid bearing for supporting impeller 70 so that impeller 70 can rotate lubricatively without contacting suction ring 84.

Meanwhile, some of the pressurized fluid that has flowed into impeller 83 enters into stator can 65 through the gap between motor shaft 63 and upper bush bearing 67*b*. The fluid that has flowed into stator can 60 cools motor 10. The fluid in stator can 65 reversely rises to flow into impeller chamber 83, and thereafter flows out of impeller chamber 83 together with other pressurized fluid therein through outlet passage 82.

However, according to the prior-art circulating pump constructed as above, since fluid that has flowed into stator can 65 through the gap between motor shaft 63 and upper bush bearing 67*b* is small in quantity, motor 60 can not be cooled satisfactorily. As such, since heat generated by friction between motor shaft 63 and bearings 67*a* and 67*b* is not sufficiently cooled, motor shaft 63 and bearings 67*a* and 67*b* are apt to be worn away earlier, and therefore the efficiency of pump 51 decreases and the expected life of pump 51 is shortened.

Also according to the prior-art circulating pump constructed as above, when a substance such as mud enters stator can 65 together with fluid through the gap between motor shaft 63 and upper bush bearing 67*b*, since the gap between motor shaft 63 and upper bush bearing 67*b* is quite narrow, the substance that has entered thereinto is hardly discharged to impeller chamber 63 again. That is, the substance remains in the stator can 65. At this time, if the substance gets in between motor shaft 63 and lower bush bearing 67*a*, a lubricative rotation of motor shaft 63 can be obstructed. Especially, if pump 51 is left not to be used for a long time, the substance will solidify so the rotation of motor shaft 63 could be impossible.

SUMMARY OF THE INVENTION

It is an object of the present invention to provide a circulating pump overcoming the deficiency described in the foregoing, that is to say, a circulating pump for cooling water to be forcibly circulated in such a manner that fluid pressurized into an impeller chamber by an impeller flows through a spiral groove formed at the outer surface of a motor shaft and a cooling water discharging passage formed at the center of the motor shaft and returns into the impeller under a pressure difference between the impeller chamber and the impeller itself so that a motor of the circulating pump is cooled satisfactorily.

The object of the present invention is achieved by providing a circulating pump for cooling water to be forcibly circulated comprising a motor, an impeller and a pump housing wherein: the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor, one end of the motor shaft being rotatably supported by a lower bush bearing at the inner bottom of the motor housing, the other end of the motor shaft being projected passing through a through hole formed at the motor end shield, the motor shaft being supported rotatably by an upper bush bearing at the through hole of the motor end shield, at the outer periphery of the motor shaft a spiral groove being formed, and at the center of the motor shaft a cooling water discharging passage is formed along the axis of the motor shaft; the impeller includes an impeller body having a plurality of blades for pressurizing fluid and fixedly assembled with the other end of the motor shaft, at the center of a lower surface of the impeller body a curved projecting portion forming a cooling water inflow chamber by joining together with an upper end of the motor shaft being provided and at the curved projecting portion one or more cooling water outlet holes being formed, and a shroud integrally fixed onto the impeller body, and at the center of the shroud a through hole being formed for allowing fluid to flow into the impeller; and the pump housing includes a housing body disposed onto the motor and comprising an inlet passage and an outlet passage provided at both sides thereof respectively and an impeller chamber communicated with the inlet passage and the outlet passage, at the center of the impeller chamber the impeller being disposed, and a suction ring fixed at an inner end of the inlet passage of the housing body and guiding fluid through the inlet passage into the impeller.

At this time, the cooling water discharging passage is tapered for the inlet of the motor housing side thereof to be narrower than the outlet of impeller side thereof. At an end of the impeller side of the cooling water discharging passage a ball seat is formed and a ball is seated therein.

According to the present invention constructed as above, when the motor shaft rotates, pressurized fluid in the impeller chamber flows into the stator can by way of the spiral groove formed at the motor shaft under the action of pressure difference between the impeller chamber and the cooling water inflow chamber and rotation of the spiral groove formed at the surface of the motor shaft. The fluid that has flowed into the stator can in such a way cools the motor. At the same time, fluid in the stator can flows into a space formed inside a lower bearing holder by way of the spiral groove formed around the lower end of the motor shaft under the pressure difference of the fluid between the impeller chamber and the cooling water inflow chamber and rotation of the spiral groove. The fluid that has flowed into the space flows out into the cooling water inflow chamber through the cooling water discharging passage by pressure difference of fluid between the space formed inside the lower bearing holder and the cooling water inflow chamber. At this time, the ball seat provided at the end of the cooling water discharging passage and the ball seated in the ball seat act as a non-return valve to prevent the fluid in the cooling water inflow chamber from reversely flowing toward the cooling water discharging passage. The fluid in the cooling water inflow chamber flows out into the impeller through the outlet hole formed at the curved projecting portion and the fluid that has flowed into the impeller is pressurized again into the impeller chamber.

Therefore, according to the circulating pump for cooling water to be forcibly circulated constructed as above, since sufficient cooling water is supplied into the stator can, heat generated by friction between the motor shaft and the bearings can be cooled satisfactorily. Also since a substance such as mud that has entered the stator can together with fluid is forcibly discharged out of the motor together with fluid via the spiral groove around the lower end of the motor shaft and the cooling water discharging passage of the motor shaft, it is possible to prevent the substance from being accumulated inside the stator can.

Also, the object of the present invention is achieved by providing a circulating pump for cooling water to be forcibly circulated comprising a motor, an impeller and a pump housing wherein: the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor, one end of the motor shaft being supported rotatably and slidably by a lower bush bearing at the inner bottom of the motor housing, the other end of the motor shaft being projected passing through a through hole formed in the motor end shield, the motor shaft being supported rotatably and slidably by an upper bush bearing at the through hole of the motor end shield, at the outer surface of the motor shaft a spiral groove being formed, and at the center of the motor shaft a cooling water discharging passage is formed along the axis of the motor shaft; the impeller includes an impeller body having a plurality of blades for pressurizing fluid and fixedly assembled with the other end of the motor shaft, at the center of a lower surface of the impeller body a curved projecting portion forming a cooling water inflow chamber by joining together with an upper end of the motor shaft being provided, and at the curved projecting portion one or more cooling water outlet holes being formed, and a shroud integrally fixed onto the impeller body, at the center of the shroud a through hole being formed for allowing fluid to flow into the impeller and at the upper end of the shroud an annular flange with a plurality of grooves being formed; and the pump housing includes a housing body disposed onto the motor and comprising an inlet passage and an outlet passage provided at both sides thereof respectively and an impeller chamber communicated with the inlet passage and the outlet passage, at the center of the impeller chamber the impeller being disposed, and a suction ring fixed at an inner end of the inlet passage of the housing body and guiding fluid through the inlet passage into the impeller.

At this time, the spiral groove is preferably composed of an upper spiral groove and a lower spiral groove. An upper end of the upper spiral groove is preferably communicated with internal space of the impeller chamber only when the impeller(accordingly, the motor shaft) is in its upward position during operation of the motor. When the motor stops and the impeller(accordingly, the motor shaft) is in its downward position, the inlet of the upper spiral groove is blocked by the upper bush bearing. A lower end of the upper spiral groove is communicated with the internal space of the stator can even when the impeller(accordingly, the motor shaft) is in its upward position during operation of the motor. An upper end of the lower spiral groove is preferably communicated with the internal space of the stator can only when the impeller(accordingly, the motor shaft) is in its upward position. When the motor stops and the impeller (accordingly, the motor shaft) is in its downward position, the inlet of the lower spiral groove is blocked by the lower bush bearing.

Also, the cooling water discharging passage is preferably tapered for the inlet of the motor housing side thereof to be narrower than the outlet of impeller side thereof. At an upper end of the cooling water discharging passage a ball seat is formed and a ball is seated therein.

In the circulating pump for cooling water to be forcibly circulated according to the present invention as above, when impeller rotates, fluid pressure in the impeller chamber is higher than that in an inside of the impeller. Accordingly the impeller is forced toward the suction ring and rises toward the suction ring while rotating. According to the rising of the impeller the motor shaft moves upward, thus the inlet of the upper spiral groove becomes communicated with the impeller chamber. Subsequently fluid in the impeller chamber flows into the stator can along the spiral groove of the motor shaft by the pressure difference between the impeller chamber and the cooling water inflow chamber and the rotation of the upper spiral groove of the motor shaft. The fluid that has flowed into the stator can cools the motor. Simultaneously, fluid in the stator can flows into the space provided inside the lower bearing holder along the lower spiral groove around the lower end of the motor shaft by the pressure difference between the impeller chamber and the cooling water inflow chamber and the rotation of the lower spiral groove. The fluid inside the lower bearing holder is discharged to the cooling water inflow chamber through the cooling water discharging passage by the pressure difference between the space inside the lower bearing holder and the cooling water inflow chamber. At this time, the ball seat provided at the upper end of the cooling water discharging passage and the ball seated therein act as a non-return valve so that reverse flow of the fluid in the cooling water inflow chamber toward the cooling water discharging passage is prevented. The fluid in the cooling water inflow chamber flows out into the impeller through the outlet holes at the curved projecting portion of the impeller body. The fluid that has flowed into the impeller is pressurized into the impeller chamber again.

Therefore, according to the circulating pump for cooling water to be forcibly circulated constructed as above, since sufficient cooling water is supplied into the stator can, heat generated by friction between the motor shaft and the bearings can be cooled satisfactorily. Also since a substance such as mud that has entered the stator can together with fluid is forcibly discharged out of the motor together with fluid via the lower spiral groove around the lower end of the motor shaft and the cooling water discharging passage of the motor shaft, it is possible to prevent the substance from being accumulated inside the stator can.

BRIEF DESCRIPTION OF THE DRAWINGS

The present invention will now be clarified by way of example with reference to the accompanying drawings in which.

DESCRIPTION OF THE PREFERRED EMBODIMENT

Figure 1:
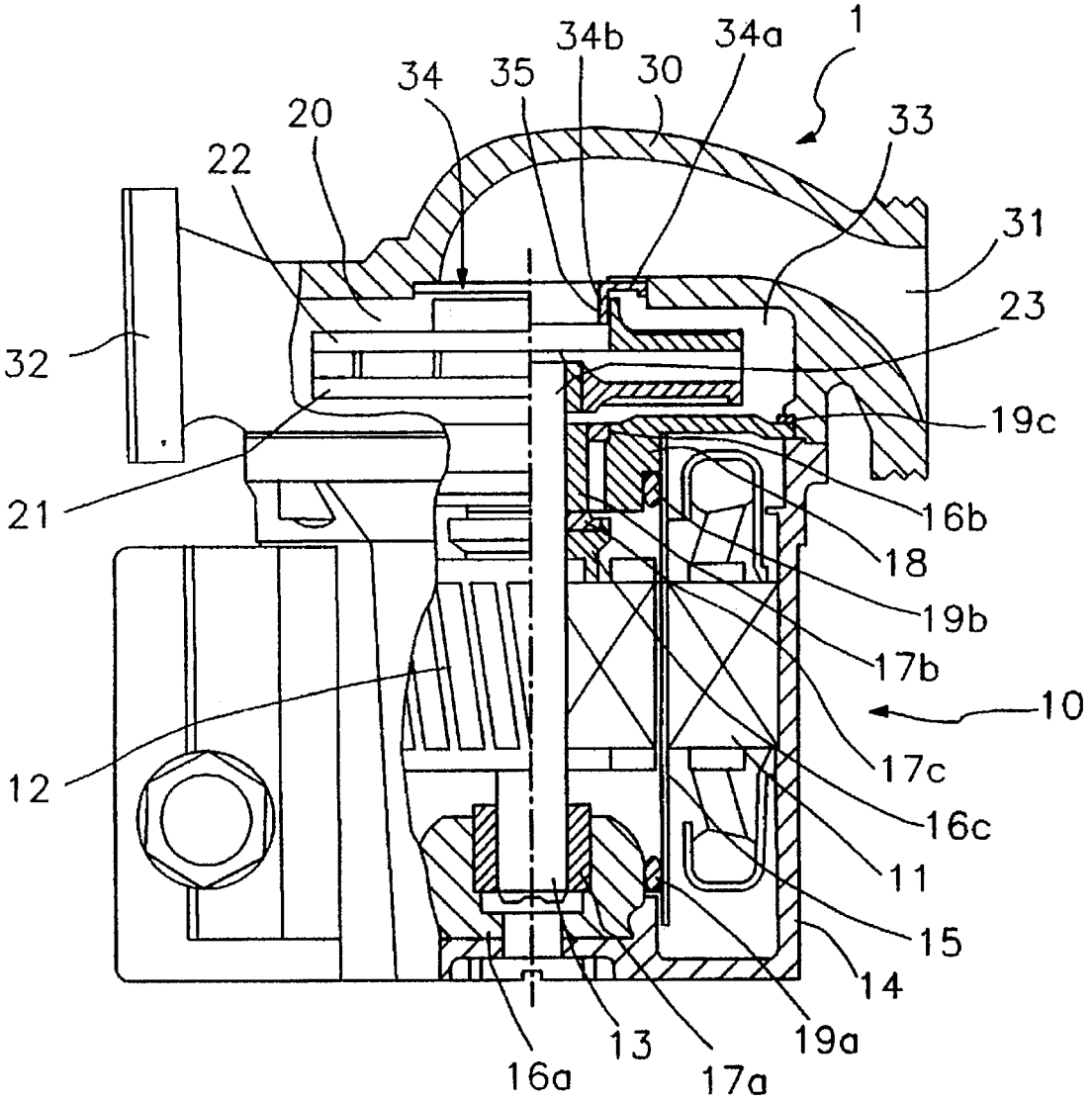
FIG. 1 PRIOR ART
FIG. 1 is a front view, partly in section, for showing a first embodiment of a prior-art circulating pump.
Figure 2:
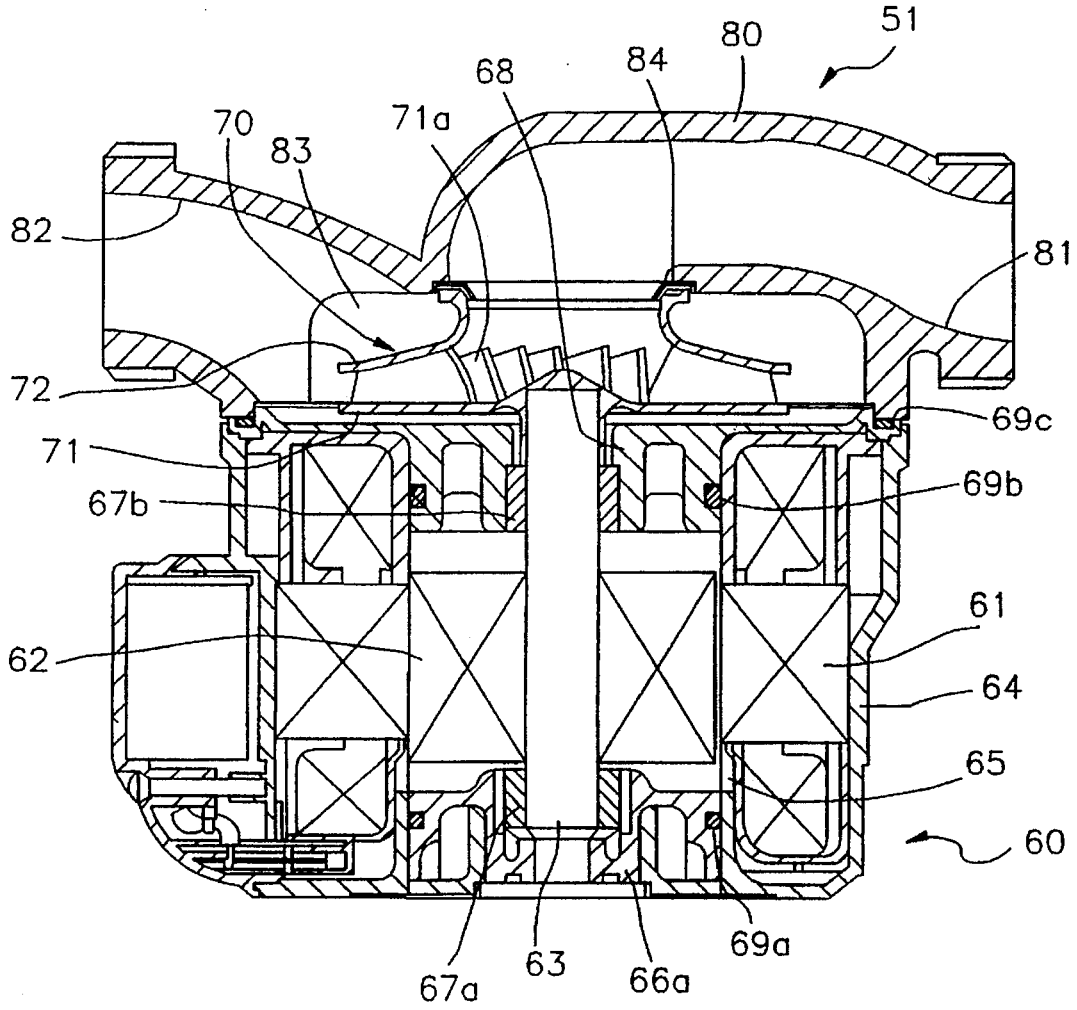
FIG. 2 PRIOR ART
FIG. 2 is a front sectional view for showing a second embodiment of the prior-art circulating pump.
Figure 3:
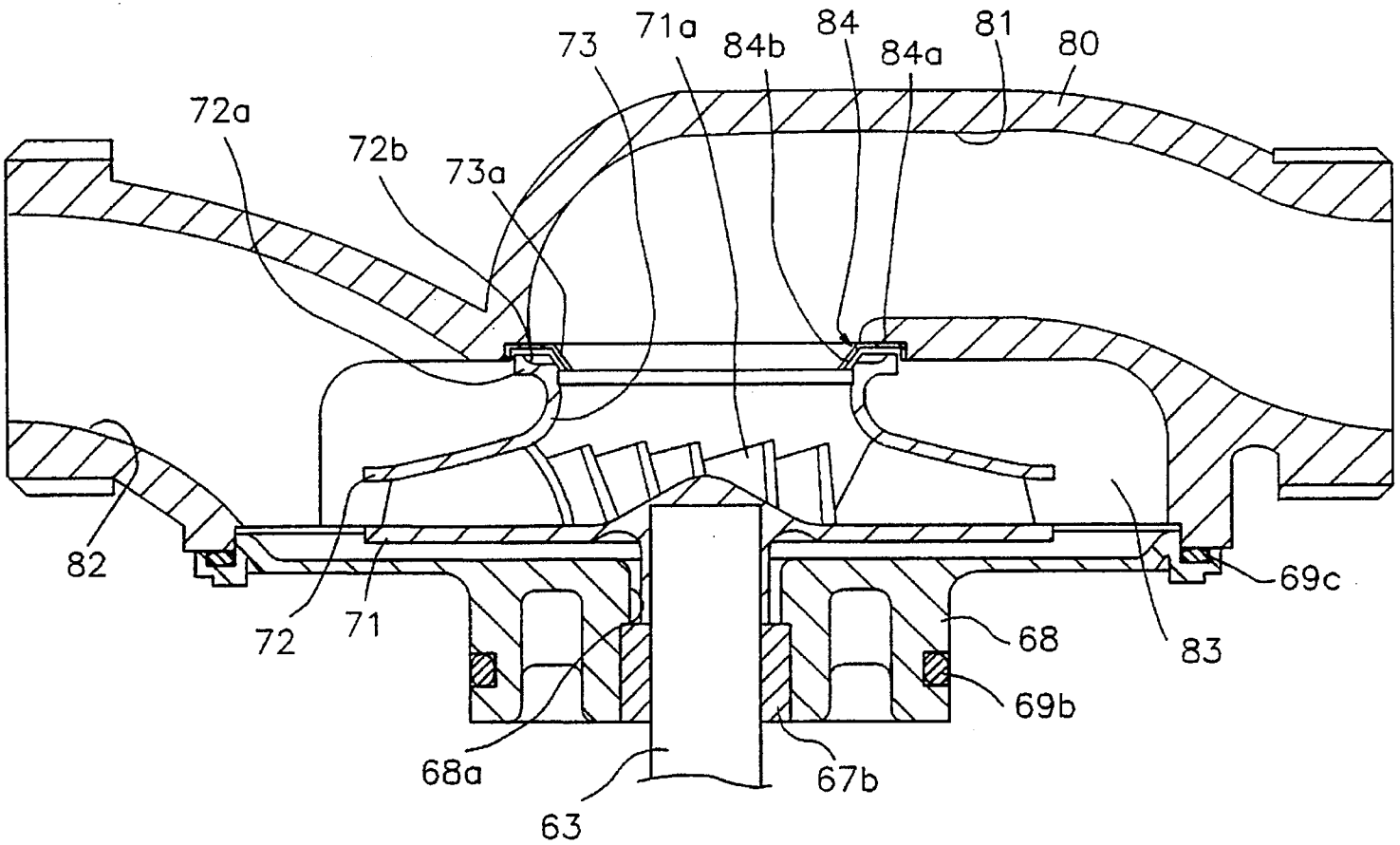
FIG. 3 PRIOR ART
FIG. 3 is a partly enlarged view for showing a dispositional relationship of an impeller and a pump housing in FIG. 2.
Figure 4:
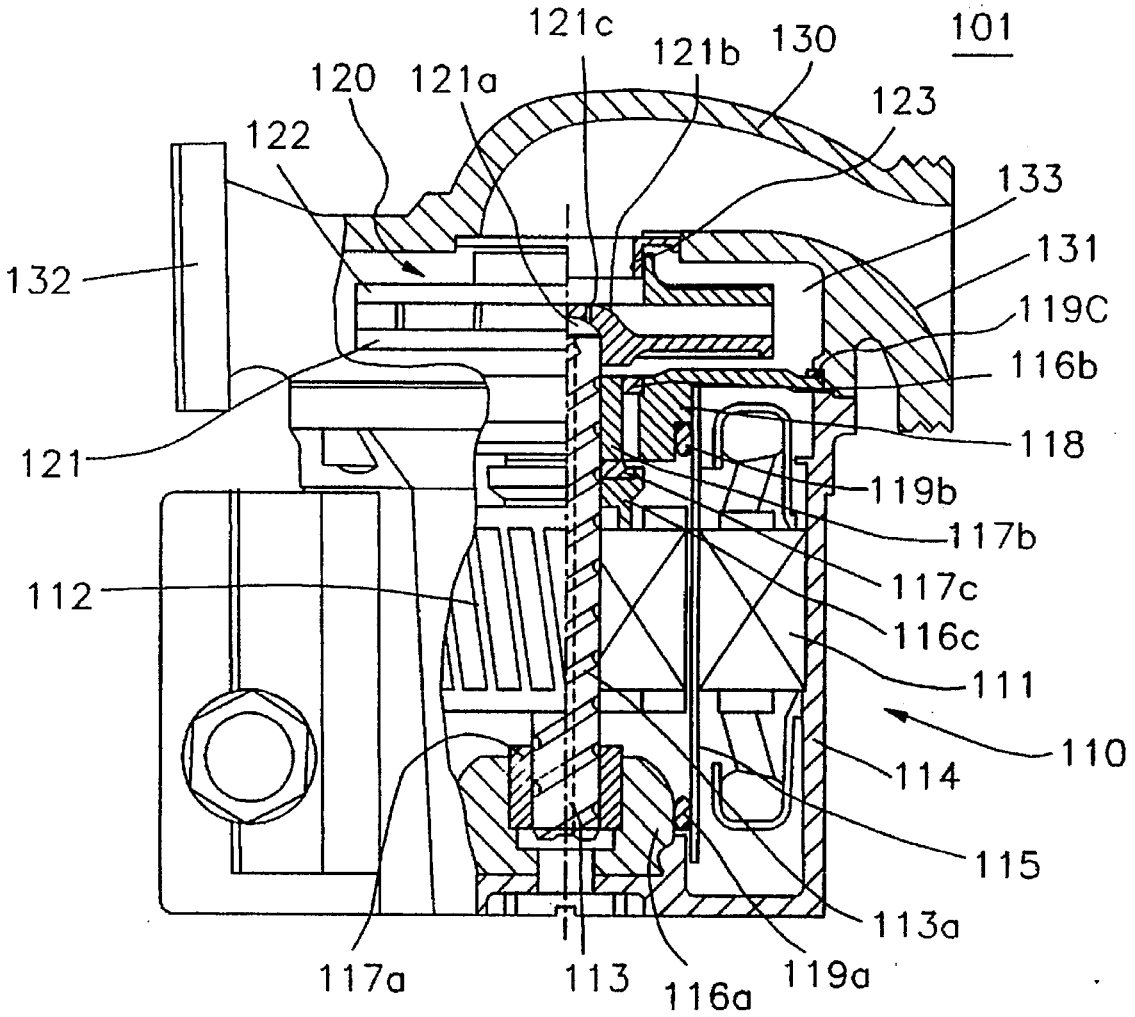
FIG. 4 is a front view, partly in section, for showing a first embodiment of a circulating pump for cooling water to be forcibly circulated according to the present invention.
Figure 5:
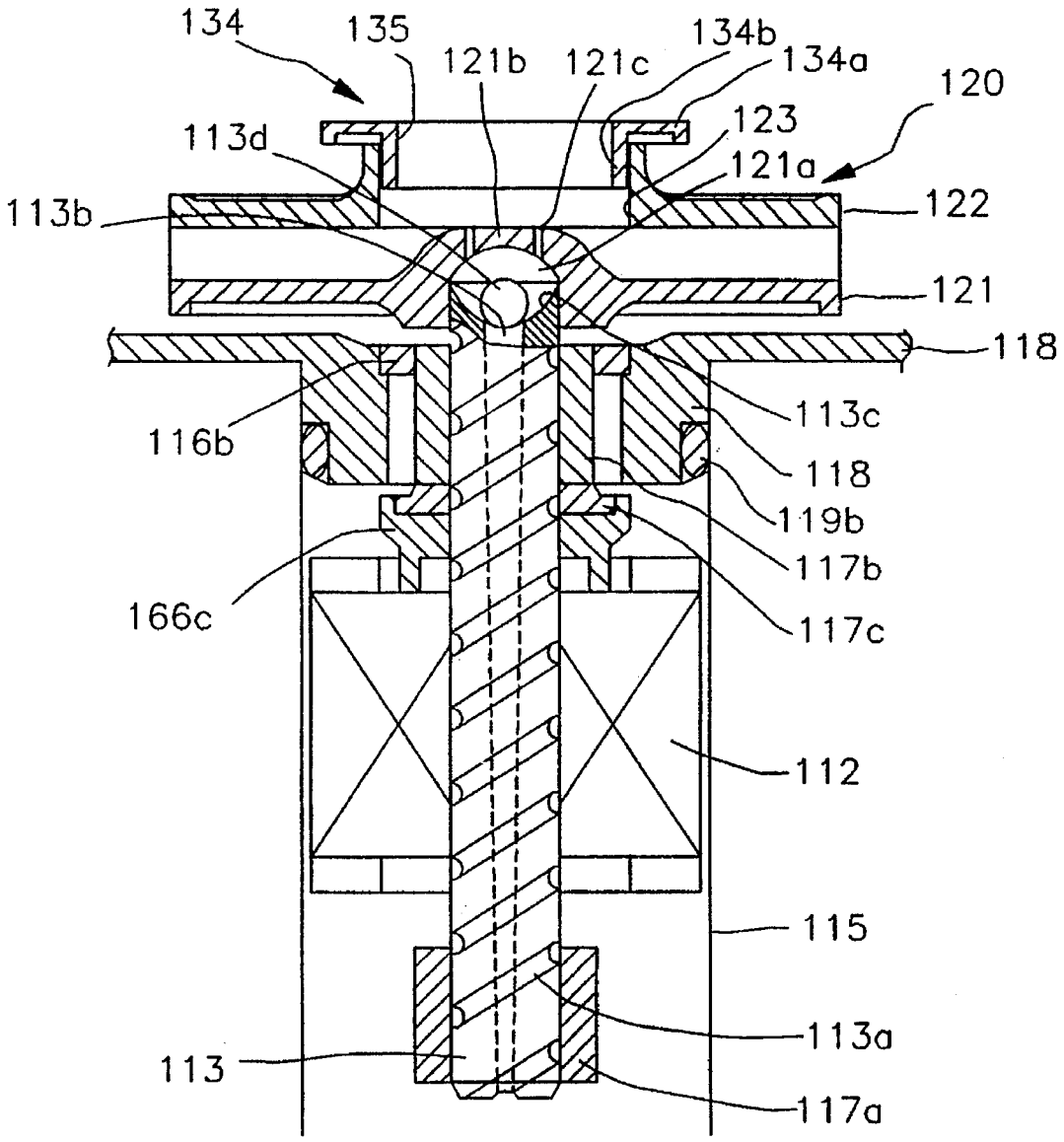
FIG. 5 is an enlarged view of a portion of "A" in FIG. 4.

FIGS. 4 and 5 illustrate a first embodiment of a circulating pump for cooling water to be forcibly circulated according to the present invention.

According to FIGS. 4 and 5, a circulating pump for cooling water to be forcibly circulated according to the present invention comprises a motor 110, an impeller 120 and a pump housing 130.

Motor 110 includes a stator 111, a rotor 112 and a motor shaft 113. Stator 111 is fixed inside a motor housing 114. Rotor 112 is fixedly assembled with motor shaft 113 and separated from stator 111 by a stator can 115. One end of motor shaft 113 is supported by a lower bearing holder 116*a* and a lower bush bearing 117*a* at the inner bottom of motor housing 114. The other end of motor shaft 113 passes through a motor end shield 118 and is supported by an upper bearing holder 116*b* and an upper bush bearing 117*b* at motor end shield 118. Motor shaft 113 is supported by a trust bearing 117*c* which is to keep the motor shaft 113 from rising in an axial direction of the motor shaft 113. At an outer surface of motor shaft 113 a spiral groove 113*a* is formed and at a center of motor shaft 113 a cooling water discharging passage 113*b* is formed along the axis thereof. Cooling water discharging passage 113*b* is tapered for the inlet to be narrower than the outlet. At an upper end of cooling water discharging passage 113*b* a ball seat 113*c* is formed and a ball 113*d* is seated therein. Between lower bearing holder 116*a* and stator can 115, a sealing member 119*a* is provided to prevent fluid from leaking out. Likewise, a sealing member 119*b* prohibits the leakage of fluid between motor end shield 118 and stator can 115.

Impeller 120 includes an impeller body 121 and a shroud 122, and impeller body 121 and shroud 122 are connected to each other by an ultrasonic welding. Impeller body 121 is tightly fitted at the other end of motor shaft 113. At lower portion of the center of impeller body 121 a curved projecting portion 121*b* forming a cooling water inflow chamber 121*a* by joining together with the other end of motor shaft 113 is provided, and at curved projecting portion 121*b* a plurality of cooling water outlet holes 121*c* are formed. At the center of shroud 122 a through hole 123 is formed.

Pump housing 130 is disposed onto motor 110. Pump housing 130 includes an inlet passage 131 and an outlet passage 132 at its right and left sides respectively and an impeller chamber 133 at the center thereof. Impeller 120 is disposed inside impeller chamber 133. A suction ring 134 with a flange 134*a* and a cylinder 134*b* is provided at one end of inlet passage 131 of pump housing 130 just above shroud 122 of impeller 120. A fluid guide hole 135 is formed at the center of suction ring 134. Cylinder 134*b* of suction ring 134 protrudes with a predetermined length into through hole 124 of shroud 122 of impeller 120. Between through hole 124 of shroud 122 and an outer wall of cylinder 134*b* of suction ring 134 and between an upper end of shroud 122 and a lower side of flange 134*a* of suction ring 134, some measure of clearance is provided. A sealing member 119*c* is provided to prevent fluid from leaking out between pump housing 130 and motor end shield 118.

In the circulating pump for cooling water to be forcibly circulated 101 according to the present invention constructed as above, when an electric current is applied to stator 111 of motor 110, motor shaft 113 which is rotatably supported against motor housing 114 by means of lower bush bearing 117*a* and upper bush bearing 117*b* rotates by an electromagnetic force occurring between stator 111 and rotor 112. When impeller 120 rotates, the fluid that has flowed into impeller 120 through inlet passage 131 and suction ring 134 of pump housing 130 is pressurized by impeller 120 and is delivered into impeller chamber 133 and subsequently to outlet passage 132.

At the same time, pressurized fluid in impeller chamber 120 flows into stator can 115 by way of spiral groove 113*a* of motor 113 under the action of pressure difference between impeller chamber 133 and stator can 115 and rotation of spiral groove 113*a* of motor shaft 113. The fluid that has flowed into stator can 115 cools motor 110. At the same time, fluid inside stator can 115 flows into a space formed inside a lower bearing holder 116*a* by way of spiral groove 113*a* around the lower end of motor shaft 113 under the action of pressure difference between stator can 115 and the space and rotation of spiral groove 113*a*. The fluid that has flowed into the space is discharged from the space to cooling water inflow chamber 121*a* through cooling water discharging passage 113*b* by pressure difference between the space and cooling water inflow chamber 121*a*. At this time, ball seat 113*c* provided at the end of cooling water discharging passage 113*b* and ball 113*d* seated at ball seat 113*c* act as a non-return valve to prevent the fluid in cooling water inflow chamber 121*a* from reversely flowing toward cooling water discharging passage 113*b*. The fluid in cooling water inflow chamber 121*a* flows out into impeller 120 through cooling water outlet holes 121*c* of curved projecting portion 121*b* and the fluid that has flowed into impeller 120 is pressurized into impeller chamber 133 again.

Therefore, according to the circulating pump for cooling water to be forcibly circulated constructed as above, since sufficient cooling water can be supplied in stator can 115, heat generated by friction between motor shaft 113 and bearings 117*a*, 117*b* and 117*c* can be cooled satisfactorily. Also since a substance such as mud that has entered stator can 115 together with other fluid is forcibly discharged out of motor 110 together with fluid via spiral groove 113*a* around the lower end of motor shaft 113 and cooling water discharging passage 113*b* formed of motor shaft 113, it is possible to prevent the substance from being accumulated inside stator can 115.

Figure 6:
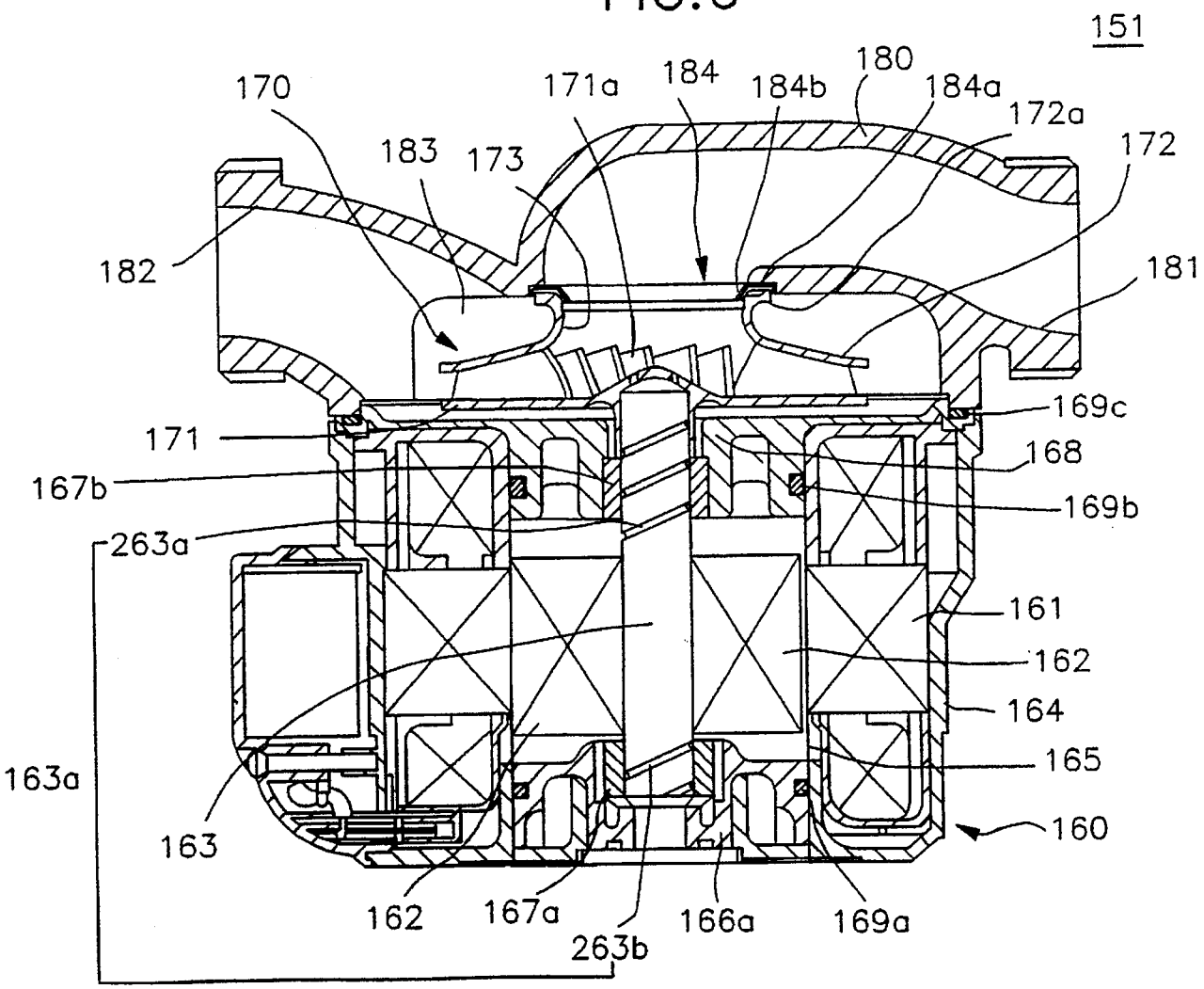
FIG. 6 is a front sectional view for showing a second embodiment of the circulating pump for cooling water to be forcibly circulated according to the present invention.
Figure 7:
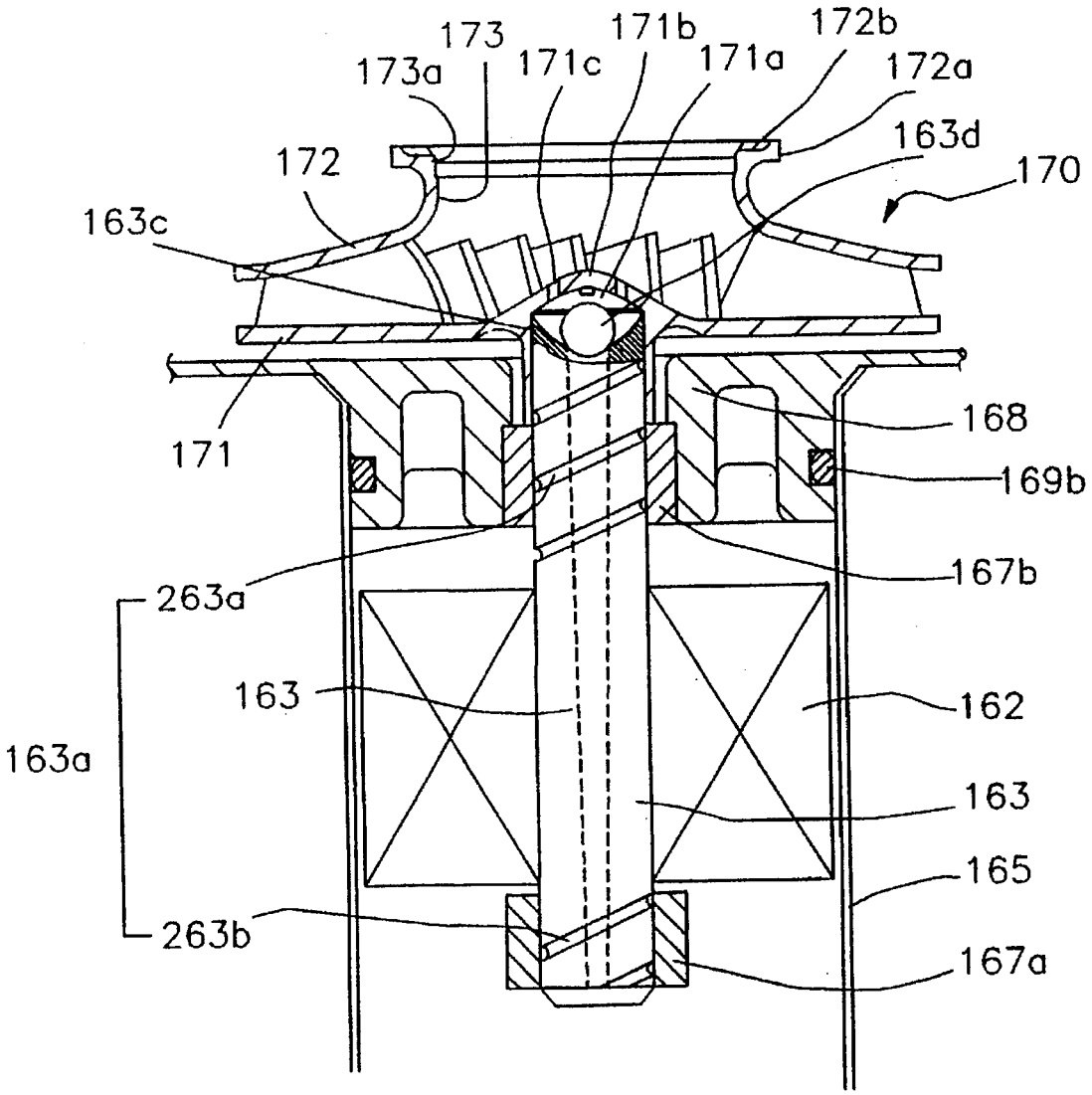
FIG. 7 is an enlarged view for showing a dispositional relationship of a motor shaft and bearings of the second embodiment according to the present invention when the pump is in abeyance.
Figure 8:
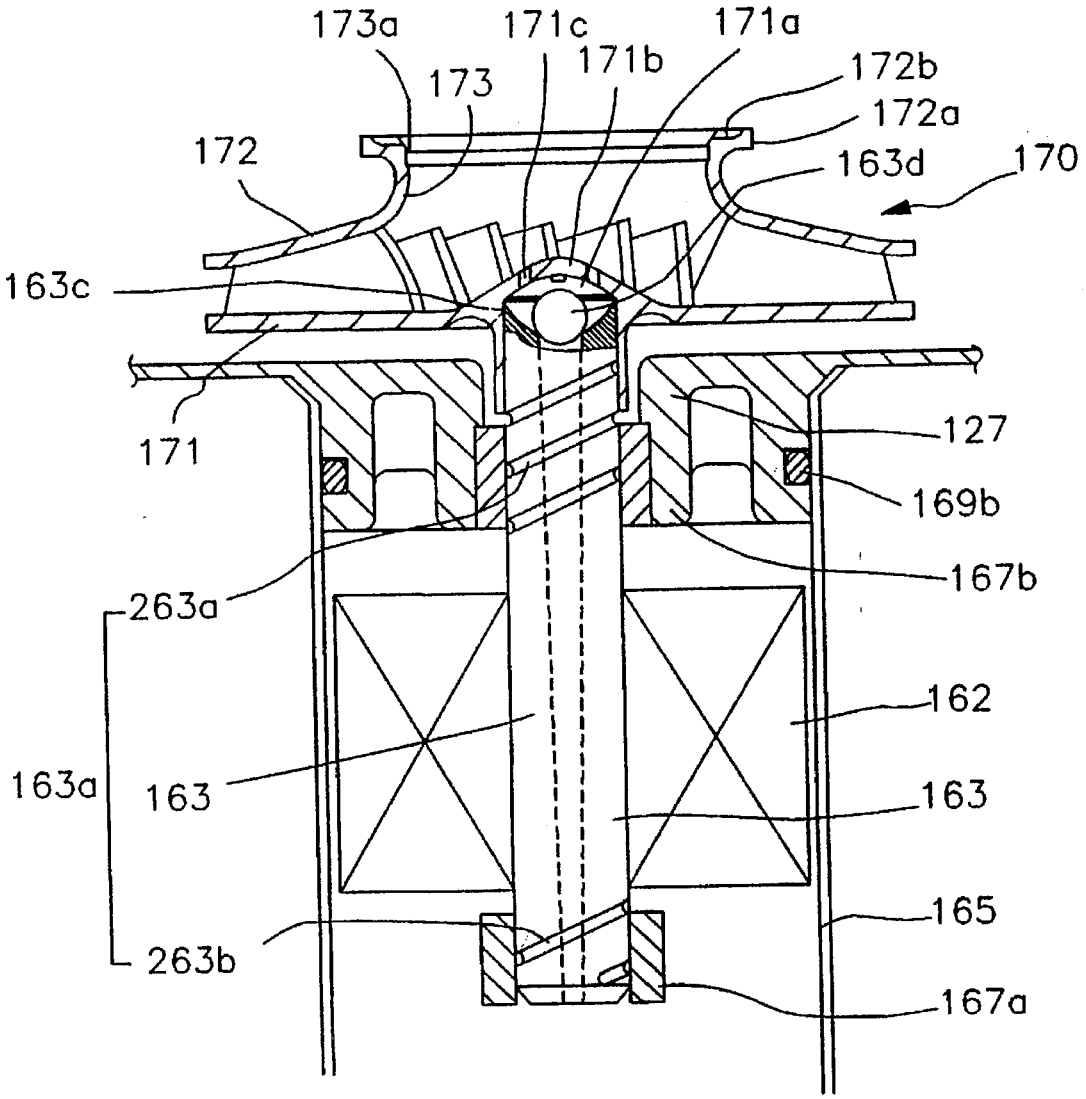
FIG. 8 is an enlarged view for showing a dispositional relationship of the motor shaft and the bearings of the second embodiment according to the present invention when the pump is in operation.

FIGS. 6–8 illustrate a second embodiment of a circulating pump for cooling water to be forcibly circulated according to the present invention.

According to FIGS. 6–8, a circulating pump for cooling water to be forcibly circulated according to the present invention comprises a motor 160, an impeller 170 and a pump housing 180.

Motor 160 includes a motor housing 164. Inside motor housing 164 a stator 161 is fixed. Stator 161 is separated from fluid by a stator can 165, a motor end shield 168 and a plurality of sealing members 169*a*, 169*b* and 169*c*. A rotor 162 is fixedly assembled with a motor shaft 163. One end of motor shaft 163 is supported rotatably and slidably in an axial direction of motor shaft 163 by a lower bearing holder 166*a* and a lower bush bearing 167*a* at the inner bottom of motor housing 164. The other end of motor shaft 163 protrudes passing through motor end shield 168 and is supported rotatably and slidably in the axial direction by an upper bush bearing 167*b* at motor end shield 168. At the outer surface of motor shaft 163 a spiral groove 163*a* is formed and at the center of motor shaft 163 a cooling water discharging passage 163*b* is formed along the axis of motor shaft 163.

Spiral groove 163*a* is composed of an upper spiral groove 263*a* and a lower spiral groove 263*b*. One end of upper spiral groove 263*a* is communicated with internal space of an impeller chamber 183 only when impeller 170 (accordingly, motor shaft 163) is in its upward position (See FIG. 8). When motor 160 stops so impeller 170 (accordingly, motor shaft 163) is in its downward position, an inlet of upper spiral groove 263*a* is blocked by upper bush bearing 167*b* (See FIG. 7). The other end of upper spiral groove 263*a* is communicated with the internal space of stator can 165 even when impeller 170 (accordingly, motor shaft 163) is in its upward position during operation of motor 160 (See FIG. 7). An upper end of lower spiral groove 263*b* is communicated with the internal space of stator can 165 only when impeller 170 (accordingly, motor shaft 163) is in its upward position (See FIG. 8). When motor 160 stops and impeller 170 (accordingly, motor shaft 163) is in its downward position, the inlet thereof is blocked by lower bush bearing 167*a* (See FIG. 7).

Cooling water discharging passage 163*b* is tapered for the inlet of motor housing 164 side thereof to be narrower than the outlet of cooling water inflow chamber 171*a* side thereof. At an upper end of cooling water discharging passage 163*b* a ball seat 163*c* is formed and a ball 163*d* is seated therein. Between lower bearing holder 166*a* and stator can 165, a sealing member 169*a* is provided to prevent fluid from leaking out. Likewise, a sealing member 169*b* prohibits the leakage of fluid between motor end shield 168 and stator can 165.

Impeller 170 includes an impeller body 171 and a shroud 172. Impeller body 171 and shroud 172 are connected to each other by an ultrasonic welding. Impeller body 171 with a plurality of blades 171*a* for pressurizing fluid is tightly fitted at the other end of motor shaft 163. At a lower portion of the center of impeller body 171 a curved projecting portion 171*b* forming a cooling water inflow chamber 171*a* by joining together with the other end of motor shaft 163 is provided, and at curved projecting portion 171*b* a plurality of cooling water outlet holes 171*c* are formed. One end of shroud 172 is fixedly fitted onto impeller body 171 and at the center of shroud 122 a through hole 173 is formed. At an upper edge of through hole 173 an inclined surface 173*a* is formed. At the other end of shroud 172 an annular flange 172*a* with a plurality of grooves 172*b* thereon is provided.

Pump housing 180 is disposed onto motor 160. Pump housing 180 includes an inlet passage 181 and an outlet passage 182 at its right and left sides respectively and an impeller chamber 183 at the center thereof. Impeller 170 is disposed inside impeller chamber 183. Impeller chamber 183 is communicated with an inlet passage 181 and an outlet passage 182. A suction ring 184 is situated at an end of inlet passage 181. Suction ring 184 includes a flange 184*a* and an inclined guiding portion 184*b* with the same angle as inclined surface 173*a* formed at the upper edge of through hole 173 of shroud 172. Between pump housing 180 and motor end shield 168 a sealing member 169*c* is provided to prevent fluid from leaking out.

According to a circulating pump for cooling water to be forcibly circulated 151 according to the present invention constructed as above, when an electric current is applied to stator 161 of motor 160, motor shaft 163 which is rotatably supported against motor housing 164 by means of lower bush bearing 167*a* and upper bush bearing 167*b* rotates and accordingly impeller 170 fixed at an end of motor shaft 163 rotates. When impeller 170 rotates, the fluid that has flowed into impeller 170 through inlet passage 181 and suction ring 184 of pump housing 180 is pressurized by a plurality of blades 171*a* of impeller 170 and is delivered into impeller chamber 183 and subsequently to outlet passage 182. Since the fluid in the impeller 170 is pressurized toward impeller chamber 183 by a plurality of blades 171*a*, the fluid pressure in impeller chamber 183 is higher than that of impeller 170 inside. Accordingly, impeller 170 is forced toward suction ring 184. Meanwhile, since motor shaft 163 at which impeller 170 is fixed is supported against motor housing 164 rotatably and slidably in an axial direction of motor shaft 163 by lower bush bearing 167*a* and upper bush bearing 167*b*, impeller 170 axially rises toward suction ring 184 while rotating.

Further, since the fluid pressure in impeller chamber 183 is higher than that of impeller 170 inside, the pressurized fluid in impeller chamber 183 flows into inlet passage 181 through clearance between an upper side of annular flange 172*a* of shroud 172 and a lower side of flange 184*a* of suction ring 184. At this time, the fluid that has flowed into the clearance is affected by a centrifugal force going back toward the outside of annular flange 172*a* by a plurality of grooves 172*b* on annular flange 172*a*. Around an outer end of grooves 172*b* pressurized fluid and fluid pressurized outwardly by grooves 172*b* conflict with each other. This fluid confliction makes a fluid film with considerable pressure between shroud 172 and suction ring 184. The fluid film serves as a fluid bearing for supporting impeller 170 so that impeller 170 can rotate lubricatively without contacting suction ring 184.

At the same time, when motor shaft 163 axially rises according to the rising of impeller 170, a closed inlet of upper spiral groove 263*a* is exposed from upper bush bearing 167*b*. Subsequently pressurized fluid in impeller chamber 183 flows into stator can 165 along upper spiral groove 263*a* of motor shaft 163 under the action of the pressure difference between impeller chamber 183 and stator can 165 and the rotation of upper spiral groove 263*a* of motor shaft 163. The fluid that has flowed into stator can 165 cools motor 160.

Simultaneously, the fluid in stator can 165 flows into a space provided inside lower bearing holder 166*a* along lower spiral groove 263*b* which is formed around the lower end of motor shaft 163 under the action of the pressure difference between stator can 165 and the space and the rotation of lower spiral groove 263*b*. An upper end of lower spiral groove 236*b* communicates with stator can 165 inside only when motor shaft 163 moves upward (See FIG. 8). The fluid that has flowed into the space is discharged through cooling water discharging passage 163*b* to cooling water inflow chamber 171*a* under the action of pressure difference between the space inside and cooling water inflow chamber 171*a*. At this time, ball seat 163*c* provided at the end of cooling water discharging passage 163*b* and ball 163*d* seated therein act as a non-return valve so that reverse flow of the fluid from cooling water inflow chamber 171*a* to cooling water discharging passage 163*b* is prevented. The fluid in cooling water inflow chamber 171*a* flows out into impeller 170 through cooling water outlet hole 171*c* of curved projecting portion of 171*b* of impeller body 171 and the fluid that has flowed into impeller 170 is pressurized into impeller chamber 183 again.

Therefore, according to circulating pump for cooling water to be forcibly circulated 151, since sufficient cooling water is supplied in stator can 165, heat generated by friction between motor shaft 163 and bearings 177*a* and 167*b* can be cooled satisfactorily. Also since a substance such as mud that has entered stator can 165 together with fluid is forcibly discharged out of motor 160 together with fluid via lower spiral groove 263*b* around the lower end of motor shaft 163 and cooling water discharging passage 163*b* of motor shaft 163, it is possible to prevent the substance from being accumulated inside stator can 165.

It should be obvious to people skilled in the art that modifications can be made to the invention described above without departing from the spirit or the scope of the invention.

What is claimed is:

1. A circulating pump for cooling water to be forcibly circulated comprising a motor, an impeller and a pump housing wherein:

the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor, one end of the motor shaft being rotatably supported by a lower bush bearing at the inner bottom of the motor housing, the other end of the motor shaft being projected passing through a through hole formed at the motor end shield, the motor shaft being supported rotatably by an upper bush bearing at the through hole of the motor end shield, at the outer periphery of the motor shaft a spiral groove being formed, and at the center of the motor shaft a cooling water discharging passage is formed along the axis of the motor shaft;

the impeller includes an impeller body having a plurality of blades for pressurizing fluid and fixedly assembled with the other end of the motor shaft, at the center of a lower surface of the impeller body a curved projecting portion forming a cooling water inflow chamber by joining together with an upper end of the motor shaft being formed and at the curved projecting portion one or more cooling water outlet holes being formed, and a shroud integrally fixed onto the impeller body, and at the center of the shroud a through hole being formed for allowing fluid to flow into the impeller; and the pump housing includes a housing body disposed onto the motor and comprising an inlet passage and an outlet passage provided at both sides thereof respectively and an impeller chamber communicated with the inlet passage and the outlet passage, at the center of the impeller chamber the impeller being disposed, and a suction ring fixed at an inner end of the inlet passage of the housing body and guiding fluid through the inlet passage into the impeller.

2. The circulating pump for cooling water to be forcibly circulated as claimed in claim 1, wherein the cooling water discharging passage is tapered at a lower inlet end the motor housing side thereof to be narrower than an upper outlet end of the cooling water inflow chamber side thereof.

3. The circulating pump for cooling water to be forcibly circulated as claimed in claim 2, wherein at an upper outlet end of the cooling water discharging passage a ball seat is formed and a ball is seated therein.

4. The circulating pump for cooling water to be forcibly circulated as claimed in claim 1, wherein at an upper end of the cooling water discharging passage a ball seat is formed and a ball is seated therein.

5. A circulating pump for cooling water to be forcibly circulated comprising a motor, an impeller and a pump housing wherein:

the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor, one end of the motor shaft being supported rotatably and slidably by a lower bush bearing at the inner bottom of the motor housing, the other end of the motor shaft being projected passing through a through hole formed in the motor end shield, the motor shaft being supported rotatably and slidably by an upper bush bearing at the through hole of the motor end shield, at the outer surface of the motor shaft a spiral groove being formed, and at the center of the motor shaft a cooling water discharging passage is formed along the axis of the motor shaft;

the impeller includes an impeller body having a plurality of blades for pressurizing fluid and fixedly assembled with the other end of the motor shaft, at the center of a lower surface of the impeller body a curved projecting portion forming a cooling water inflow chamber by joining together with an upper end of the motor shaft being formed, and at the curved projecting portion one or more cooling water outlet holes being formed, and a shroud integrally fixed onto the impeller body, at the center of the shroud a through hole being formed for allowing fluid to flow into the impeller and at the upper end of the shroud an annular flange with a plurality of grooves being formed; and the pump housing includes a housing body disposed onto the motor and comprising an inlet passage and an outlet passage provided at both sides thereof respectively and an impeller chamber communicated with the inlet passage and the outlet passage, at the center of the impeller chamber the impeller being disposed, and a suction ring fixed at an inner end of the inlet passage of the housing body and guiding fluid through the inlet passage into the impeller.

6. The circulating pump for cooling water to be forcibly circulated as claimed in claim 5, wherein the spiral groove includes an upper spiral groove and a lower spiral groove, one end of the upper spiral groove being communicated with an internal space of the impeller chamber only when the impeller and shaft are in an upward position during an operation of the motor, an inlet of the upper spiral groove being blocked by the upper bush bearing when the motor stops and the impeller are shaft are in its downward position, the other end of the upper spiral groove being communicated with internal space of the stator can even when the impeller is in its upward position, an upper end of the lower spiral groove being communicated with internal space of the stator can only when the impeller are shaft are a in its upward position and an inlet of the lower spiral groove being blocked when the motor stops and the impeller are in their downward position.

7. The circulating pump for cooling water to be forcibly circulated as claimed in claim 6, wherein the cooling water discharging passage is tapered at a lower inlet end of the motor housing side thereof to be narrower than an upper outlet end of the cooling water inflow chamber side thereof.

8. The circulating pump for cooling water to be forcibly circulated as claimed in claim 6, wherein at an upper outlet end of the cooling water discharging passage a ball seat is provided and a ball is seated therein.

9. The circulating pump for cooling water to be forcibly circulated as claimed in claim 5, wherein the cooling water discharging passage is tapered at a lower inlet end of the motor housing side thereof to be narrower than an upper outlet of the cooling water inflow chamber side thereof.

10. The circulating pump for cooling water to be forcibly circulated as claimed in claim 9, wherein at an upper outlet end of the cooling water discharging passage a ball seat is provided and a ball is seated therein.

11. The circulating pump for cooling water to be forcibly circulated as claimed in claim 5, wherein at an upper end of the cooling water discharging passage a ball seat is provided and a ball is seated therein.

* * * * *